US008602730B2

(12) United States Patent
Richter et al.

(10) Patent No.: US 8,602,730 B2
(45) Date of Patent: Dec. 10, 2013

(54) MULTI STAGE RADIAL COMPRESSOR

(75) Inventors: Franz-Arno Richter, Dorsten (DE); Heinrich Voss, Bottrop (DE); André Hildebrandt, Oberhausen (DE); Christoph Jakiel, Dorsten (DE)

(73) Assignee: MAN Diesel & Turbo SE, Augsburg (DE)

( * ) Notice: Subject to any disclaimer, the term of this patent is extended or adjusted under 35 U.S.C. 154(b) by 898 days.

(21) Appl. No.: 12/767,006

(22) Filed: Apr. 26, 2010

(65) Prior Publication Data

US 2010/0272564 A1 Oct. 28, 2010

(30) Foreign Application Priority Data

Apr. 27, 2009 (DE) ..... 10 2009 019 061

(51) Int. Cl.
*F04D 29/44* (2006.01)

(52) U.S. Cl.
USPC ..... 415/211.2; 415/206

(58) Field of Classification Search
USPC ..... 415/199.1, 199.2, 206, 211.2
See application file for complete search history.

(56) References Cited

U.S. PATENT DOCUMENTS

| | | | | |
|---|---|---|---|---|
| 2,017,544 | A * | 10/1935 | McHugh | 415/134 |
| 2,372,880 | A * | 4/1945 | Browne | 415/208.3 |
| 4,579,509 | A | 4/1986 | Jacobi | |
| 4,645,419 | A * | 2/1987 | Furuya et al. | 415/208.2 |
| 5,062,766 | A * | 11/1991 | Miura et al. | 415/199.1 |
| 5,490,760 | A | 2/1996 | Kotzur | |
| 6,203,275 | B1 * | 3/2001 | Kobayashi et al. | 415/199.2 |

FOREIGN PATENT DOCUMENTS

| | | |
|---|---|---|
| DE | 19502808 C2 | 2/1997 |
| DE | 19654840 C2 | 12/2001 |
| JP | 2010-216456 | 9/2010 |

* cited by examiner

*Primary Examiner* — Ninh H Nguyen
(74) *Attorney, Agent, or Firm* — Cozen O'Connor

(57) ABSTRACT

A multistage radial compressor (1) with at least two compressor stages for compressing a fluid has a compressor housing (16) in which a flow channel (2) is formed for the fluid to be compressed; an impeller (4) with a plurality of impeller vanes (5) which are arranged in the flow channel (2) and are rotatable with the impeller (4) around a driveshaft (A), and a 3D return blading (8) with a plurality of return vanes (9) which are fixed with respect to rotation relative to the compressor housing (16). The flow channel (2) has a curved deflecting channel (7) which is arranged in front of the return vanes (9) in the flow direction. A vane base (11) and/or, axially downstream thereof, a vane head (12) of the return vanes (9) of the 3D return blading (8) have/has a curvature, and/or the return vanes (9) have a first vane angle distribution (17) at the vane base (11) and a second vane angle distribution (18) differing from this at the vane head (12).

23 Claims, 3 Drawing Sheets

MULTI STAGE RADIAL COMPRESSOR

BACKGROUND OF THE INVENTION

1. Field of the Invention

The present invention is directed to a multistage radial compressor for compressing in particular gaseous fluids.

2. Description of the Related Art

The compressor of the present invention includes a housing in which a flow channel is formed for the fluid to be compressed, an impeller with a plurality of impeller vanes which are arranged in the flow channel and are rotatable with the impeller around a driveshaft, and 3D return blading with a plurality of return vanes which are fixed with respect to rotation relative to the compressor housing. The flow channel has a curved deflecting channel which is arranged in front of the return vanes in the flow direction.

A radial compressor of the type mentioned above is known, for example, from DE 42 34 739 C1 corresponding to U.S. Pat. No. 5,490,760, DE 196 54 840 A1, DE 34 30 307 A1 corresponding to U.S. Pat. No. 4,579,509, and DE 195 54 840 A1.

Particularly at higher volume flows, the flow angle distribution at the entrance of a 180-degree bend between two stages of the compressor is very uneven as a result of the impeller outlet flow, which leads to severe faulty inlet flows in the previously known 2D return blading and, therefore, to unwanted flow losses. If the diffuser ratio is decreased in order to achieve smaller structural dimensions, the incident flow losses and secondary flow losses increase.

DE 195 02 808 C2 discloses a single-stage radial compressor having a stationary guide wheel or diffuser on the radial outer side of an impeller. The guide vanes of the diffuser have a twist along their length in the manner of a logarithmic spiral so that the guide vanes have inlet edges and outlet edges that are twisted relative to one another. Use of the diffuser as return blading to a subsequent vane with an inlet flow from a curved deflecting channel is not considered.

SUMMARY OF THE INVENTION

It is an object of the present invention to provide an improved radial compressor.

A radial compressor according to the present invention has two or more radial compressor stages for compressing a fluid, particularly a gaseous fluid such as, e.g., air or a process gas. To this end, the compressor comprises a compressor housing formed of one or more parts in which at least one flow channel is formed for deflecting the fluid to be compressed. Each stage has an impeller with a plurality of impeller vanes which are arranged in the flow channel and are rotatable together with the impeller around a longitudinal axis or axis of rotation.

A deflecting channel which is preferably curved substantially by 180° is formed between two stages in the flow channel and is arranged after the impeller vanes of the upstream stage in direction of flow and in front of the impeller vanes of the downstream stage in direction of flow in order to return the compressed fluid exiting from the upstream stage back to the downstream stage.

Arranged behind the curved deflecting channel in direction of flow is a return blading having a plurality of return vanes which are fixed with respect to rotation relative to the compressor housing and may be formed integral therewith, for example, by casting, cutting or erosive machining, or the like, or fastened therein so as to be removable, for example, by insertion or screwing, or they may be non-detachably fastened, for example, by welding or riveting.

The return blading is constructed as 3D blading, i.e., with a curvature which varies over the axial vane width at least in some areas. The return vanes each have a vane base and a vane head which is arranged axially behind the vane base, i.e., at a greater axial distance from the stage arranged in front in the direction of flow. The vane base and vane head define the axial vane width and define the flow channel axially. In particular, as used herein, an axially foremost cross section of the return blading which faces the upstream stage can be designated as the vane base, and an axially rearmost cross section of the return blading facing the downstream stage can be designated correspondingly as the vane head.

According to a first aspect of the present invention, the vane base and/or the vane head have/has in meridian section or meridional section a curvature different than zero and infinity at least in a certain area or areas. In particular, an axial height of the vane base or vane head, i.e., its distance from a reference plane which is oriented normal to the longitudinal axis or axis of rotation, can vary nonlinearly with the length or with the radial extension of the return vanes. In contrast to the known linear, i.e., straight or sloping, vane heads and vane bases, the flow in the return blading can be optimized in this way.

A curved vane base or vane head of this type this which is nonlinear in the axial direction can be defined, for example, by a preferably piecewise-defined polynomial function along the radius for the axial height relative to a normal plane on the axis of rotation, for example, a spline function or Bézier curve. The curved vane base or vane head preferably transitions into the adjoining areas of the flow channel in a continuous manner, preferably smoothly, i.e., so as to be continuously differentiable one or more times, in particular without a discontinuity in curvature.

The curve of the axial height of the vane base and vane head defined above along a reference plane perpendicular to the axis of rotation along the return vanes can have one or more at least local extrema, i.e., one or more minima and/or maxima. In particular, when the curve has at least one local or global minimum and maximum, the curve can have one or more inflection points in which the curvature changes.

According to a second aspect of the present invention which can be combined with the first aspect described above, a radius of curvature of the deflecting channel varies over the length of the deflecting channel. The radius of curvature can be defined, for example, by the distance of the connecting line of the centroids of the cross sections of the deflecting channel, or the distance of its radial inner or outer boundary, from a center point of the curvature. In particular, the radius of curvature of the deflecting channel can vary in a nonlinear manner over the length of the deflecting channel. In contrast to the known deflecting channels which are formed with a constant radius of curvature, i.e., as arc segments, the inlet flow into the return blading can be optimized in this way.

In a preferred embodiment, the radial inner or outer boundary of the deflecting channel varies differently at least in some area so that different channel heights result along the length of the deflecting channel.

A varying radius of curvature can likewise be defined, for example, by a preferably piecewise-defined polynomial function over the length of the deflecting channel or deflecting angle, for example, a spline function or Bézier curve. The curved deflecting channel preferably transitions into the adjoining areas of the flow channel continuously, preferably smoothly, i.e., so as to be continuously differentiable one or more times, particularly without a discontinuity in curvature.

The curve of the radius of curvature defined above can have one or more at least local extrema, i.e., one or more minima and/or maxima. In particular, when the radius has at least one local or global minimum and maximum, the curve can have one or more inflection points in which the radius of curvature changes.

According to a third aspect of the present invention which can be combined with the first and/or second aspect described above, the return vanes of the 3D return blading have a first vane angle distribution at the vane base and a second vane angle distribution at the vane head which differs from the first vane angle distribution.

As is conventional in the art, the vane angle distribution refers to the curve or run of the vane angle over the meridional length of the vane, i.e., in direction of the flow of fluid, i.e., the angle that encloses a characteristic profile line of the vanes, particularly the median line or profile center line, with a tangent at the circumference.

Accordingly, different vane angle distributions at the vane base and vane head correspond to different vane angle curves in the longitudinal direction of the vane in an axial front cross section and axial rear cross section of the return blading.

A three-dimensional vane shape manifesting itself in a twisting of the vane surface is generated by the uneven vane angle distribution at the vane head and vane base according to the invention. In this way, inhomogeneities in the flow angle distribution resulting from the impeller outlet flow of the upstream stage and/or the 180-degree bend of the curved deflecting channel can be reduced or compensated, which makes it possible to improve the incident flow of the downstream stage, reduce the flow incidence and improve the guidance of the flow. The efficiency of the radial compressor stage can advantageously be increased in this way. At the same time, the diffuser ratio can also be reduced, which makes it possible to reduce the structural dimensions of the entire radial compressor.

At the entrance into the return blading, a first vane inlet angle at the vane base is preferably greater than or less than a second vane inlet angle at the vane head. Vane inlet angle refers to the vane angle at the upstream front area of the vane, i.e., in the area in which the fluid first impinges on the vane.

Particularly advantageous ratios result in the flow when the ratio of one of the first and second vane inlet angles to the other of the first and second vane inlet angles is greater than or equal to 1.1, preferably greater than or equal to 1.2, and particularly greater than or equal to 1.3 and/or when one of the first and second vane inlet angles is greater than the other of the first and second vane inlet angles by at least 5°, particularly by at least 10°.

A first vane outlet angle at the vane head is preferably substantially identical to a second vane outlet angle at the vane base. Vane outlet angle refers to the vane angle at the downstream rear area of the vane, i.e., in the area in which the flow exits the vane. In this way, a two-dimensional, untwisted vane is advantageously realized at the vane outlet, which improves the incident flow of the downstream compressor stage. The vane outlet angles can range between 80° and 100°, for example, particularly between 85° and 95°, and amount substantially to 90° in a preferred embodiment.

Accordingly, by means of the different vane angle distributions according to the invention in the vane base and vane head of the return blading, different vane inlet angles and substantially identical vane outlet angles can be combined in the vane base and vane head in order to optimally adapt the return blading to the flow ratios, particularly its incident flow at the vane inlet and its outlet flow at the vane outlet.

A ratio between a change in the vane angle, i.e., the difference between the vane outlet angle and the vane inlet angle, at one of the vane head or vane base to a change in vane angle at the other of the vane head or vane base is preferably greater than or equal to 1.1, particularly greater than or equal to 1.14.

The first vane angle at the vane base and/or the second vane angle at the vane head preferably changes monotonously, in particular highly monotonously, between the inlet into the return blading and the outlet out of the return blading. Monotonously increasing or monotonously decreasing describes a vane angle distribution at which the vane angle at a determined point between the vane inlet and vane outlet is always greater than or equal to or less than or equal to the vane angle in every area upstream of this point. Highly monotonously increasing or decreasing in a corresponding sense describes a vane angle distribution at which the vane angle at a determined point between the vane inlet and vane outlet is always greater than or less than the vane angle in every area upstream of this point. A vane profile of this kind can be advantageous in fluidic and manufacturing respects.

When a pressure side or suction side or a median line of a vane base or vane head of a return vane is described, for example, in cylinder coordinates by the curve of the axial height h and of the angle β in circumferential direction depending on the radius r, the first aspect can be described particularly by a nonlinear function:

$$h=h(r)\neq a\times r+b;\ a,b=\text{const.},$$

or $$\partial h/\partial r\neq a,$$

and the second aspect can be described correspondingly particularly by $$R=R(\rho)\neq\text{const.},$$

or $$\partial R/\partial\rho\neq a,$$

with radius of curvature R and deflection angle ρ which preferably extends from approximately 0° to approximately 180°, and the third aspect can be described correspondingly by $$\beta_{vane\ base}=\beta_{vane\ base}(r)\neq\beta_{vane\ head}(r)$$

which applies at least in areas $r\in[r_{vane\ inlet}, r_{vane\ outlet}]$.

The return vanes have an outer diameter and an inner diameter. Inner diameter refers to the smallest distance between a downstream outlet edge of the vane which is preferably parallel to the longitudinal axis of the radial compressor or the axis of rotation of the impeller and this longitudinal axis. Also, the upstream inlet edge facing the deflecting channel can be parallel to the longitudinal axis. Alternatively, an axially inclined inlet edge which forms an angle with the longitudinal axis in the meridional view is also possible. An angle of this kind preferably lies within a range between 5° and 65° to ensure an optimal inlet flow into the return blading. Axially parallel and inclined inlet edges can also be arranged in radial direction below the deflecting channel in which the flow is preferably deflected by about 180°, the edges can line up with the outlet from the deflecting channel, or the edges can project in radial direction into the deflecting channel to optimize the flow into the return blading and the flow deflection in the deflecting channel. In a corresponding manner, outer diameter can be defined by a maximal, minimal or mean distance of the upstream inlet edge of the vane and of the longitudinal axis.

The ratio between the outer diameter and inner diameter is preferably less than or equal to 1.6, particularly less than or equal to 1.55. The different vane angle distribution according to the invention and the resulting reduction in incidence losses and secondary flow losses permits formation of the radial installation space of the radial compressor without excessive losses.

The vane surfaces of the return vanes can preferably be represented by rulings, as they are called, so that no bow is introduced in the vane turn.

The various features of novelty which characterize the invention are pointed out with particularity in the claims annexed to and forming a part of the disclosure. For a better understanding of the invention, its operating advantages, and specific objects attained by its use, reference should be had to the drawing and descriptive matter in which there are illustrated and described preferred embodiments of the invention.

BRIEF DESCRIPTION OF THE DRAWINGS

These and other advantages and features will become more apparent after referring to the following detailed description and drawings.

DETAILED DESCRIPTION OF THE PRESENTLY PREFERRED EMBODIMENTS

Figure 1:
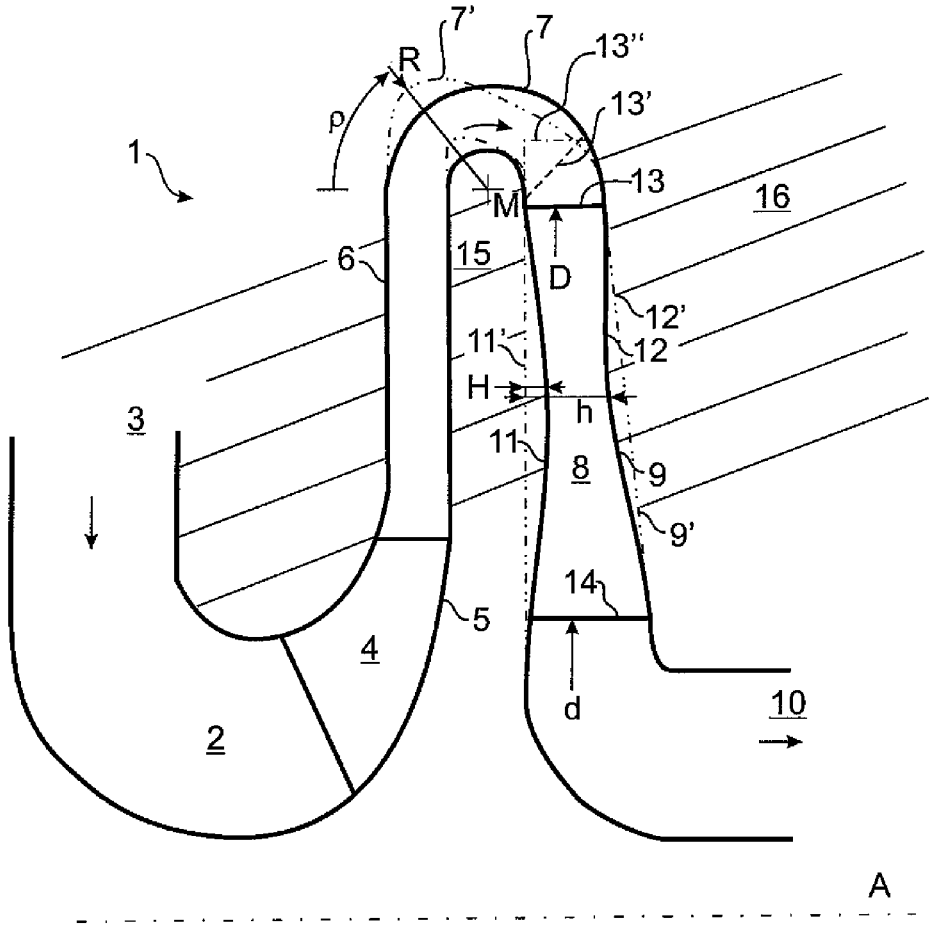
FIG. 1 shows a portion of a radial compressor according to two embodiments of the present invention in meridional section.

FIG. 1 shows the meridional section of a radial compressor stage of a multistage radial compressor 1 in a first embodiment of the present invention (solid lines) and in another embodiment of the present invention (dash-double-dotted line). It can be seen that the flow channel 2 comprises a stage inlet 3. A fluid to be compressed which is conveyed, for example, from another, upstream radial compressor stage (not shown) flows into this stage inlet 3. The flow direction is indicated by arrows.

An impeller 4 comprising a plurality of impeller vanes 5 is arranged in a first lower bend of the flow channel 2. The impeller 4 is connected to a driveshaft, not shown, so as to be fixed with respect to rotation relative to it and is rotated by this driveshaft around an axis of rotation or longitudinal axis A. Downstream of the impeller 4, the fluid reaches a diffuser portion 6 adjoined by a curved deflecting channel 7 which substantially forms a 180-degree bend.

In the embodiment shown in dash-double-dotted lines, the radius of curvature R, in this case, the distance of the radial outer boundary of the deflecting channel from a fixed center of curvature M, varies over the length of the deflecting channel 7', i.e., with deflecting angle ρ which extends from 0° to 180°. The radius of curvature of the radial inner boundary of the deflecting channel varies in a different manner, so that the cross section of the deflecting channel 7' likewise varies over the length of the deflecting channel 7'. In a modification, not shown, the cross section can also remain substantially constant over the length of the deflecting channel.

The fluid then flows in radial inward direction through a return blading 8 comprising a plurality of return vanes 9 which are fixedly connected to a compressor housing 16, shown schematically by hatching, or are formed integral therewith.

After flowing through the return blading 8, the fluid reaches the stage outlet 10 after a 90-degree bend and then passes into another downstream stage, not shown, which is preferably constructed identical to the stage shown in FIG. 1. The entire arrangement is held inside the compressor housing 16 which can be formed of multiple parts.

It can be seen that the return vanes 9 each have an axially front vane base 11 (at left in FIG. 1). In the embodiment shown in solid lines, this vane base 11 is curved in a nonlinear manner in axial direction and in meridional section, for example, parabolically, so that its axial height H initially increases over the length of the return vanes 9 or the radius, i.e., the distance from the axis of rotation A, starting from a minimum at the vane inlet 13 until a maximum approximately in the center of the vane and then decreases again to another minimum. The smooth transition into the deflecting channel 7 and vane outlet 10 without discontinuities in height or a change thereof along the radius results in two inflection points in which the sign of the curvature changes and which can coincide in the embodiment example with the minima at the vane inlet and vane outlet.

In the other embodiment, shown in dash-double-dotted lines, the vane base 11' considered in meridional section, is oriented perpendicular to the axis of rotation A and is likewise arranged at a rear side 15 of the diffuser portion 6.

Further, it can be seen that the return vanes 9 each have an axial rear vane head 12 (at right in FIG. 1). In the embodiment shown in solid lines, this vane head 12 is likewise curved nonlinearly in axial direction and in meridional section so that its axial height h initially decreases over the length of the return vanes 9 or radius starting from a local maximum at the vane inlet 13 until a global minimum approximately in the center of the vane and then increases to a global maximum. The smooth transition into the deflecting channel 7 and stage outlet 10 without discontinuities in height or a change thereof along the radius results in two inflection points in which the sign of the curvature changes and which lie in the embodiment example approximately at 25% and 75% of the radial vane length or in the center between the maximum and minimum.

In the other embodiment indicated by dash-double-dotted lines, the vane head 12' located across from the vane base 11 extends linearly, i.e., without curving, considered in meridional section and is inclined relative to a perpendicular on the axis of rotation A resulting in a conical expansion of the return blading 8. In the area of the return blading 8, the flow channel 2 has a conical expansion corresponding to the return blading 8.

Figure 2:
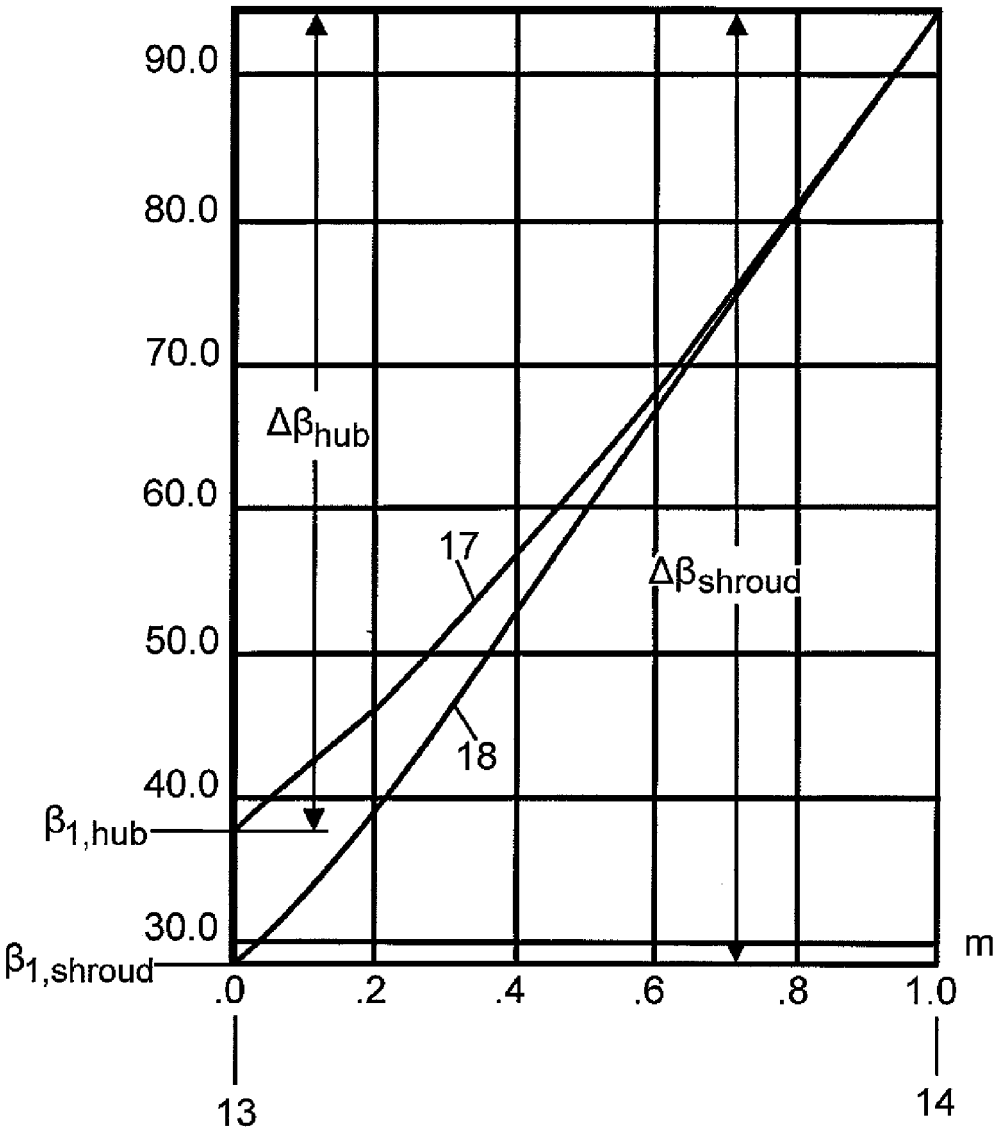
FIG. 2 shows a vane angle distribution of a return vane of the radial compressor according to FIG. 1.

FIG. 2 shows the vane angle distributions 17 at the vane base 11 and vane angle distribution 18 at the vane head 12 over their entire length starting from a vane inlet 13 to a vane outlet 14. The vane angle distributions correspond to one another in both constructions. It can be seen that a vane inlet angle $\beta_{1,hub}$ of the vane base 11 is approximately 38°. A vane inlet angle $\beta_{1,shroud}$ of the vane head 12 is about 28°. Starting from the respective vane inlet angle, the vane base and the vane head have a different total angular change $\Delta\beta_{hub}$ and $\Delta\beta_{shroud}$, respectively, where $\Delta\beta_{hub}$ is about 56° and $\Delta\beta_{shroud}$ is about 66°.

At the vane base 11 and at the vane head 12, the twisting starting from the respective vane inlet angle adds up to about 94°. Accordingly, the vane outlet angle of the vane base 11 is identical to that of the vane head 12. Therefore, there is a two-dimensional vane shape locally at the vane outlet 14 so that there is no twisting of the vane surface at the vane outlet 14 relative to the axis of rotation A.

The ratio of the vane angle change $\Delta\beta_{shroud}/\Delta\beta_{hub}$ is 1.14. The vane angle distributions 17, 18 exhibit a highly monotonous curve or run along the length of the vane base 11 and vane head 12.

Figure 3:
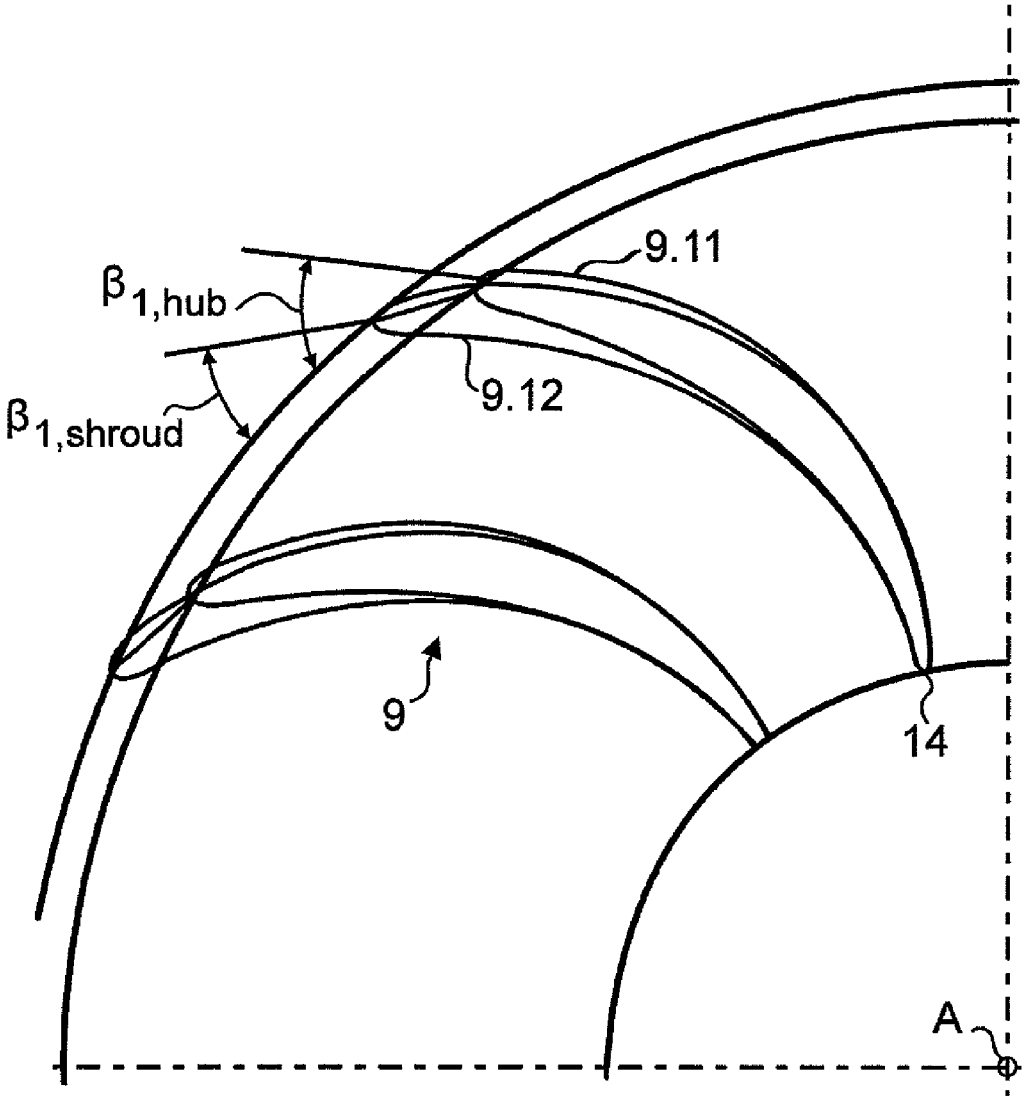
FIG. 3 shows two return vane cross sections of two return vanes of the radial compressor according to FIG. 1 at the vane base and vane head.

FIG. 3 shows the cross sections of two return vanes 9, coinciding in both constructions, in two section planes at a distance from one another axially at the vane base 11 (index "0.11") and vane head 12 (index "0.12"). The curvature in axial direction, i.e., out of the drawing plane of FIG. 3, is not visible. This radial-circumferential view shows the vane inlet angle $\beta_{1,hub}$ at the vane base 11 and the vane inlet angle $\beta_{1,shroud}$, at the vane head 12. It can be seen that the vane contour in the head cross section 9.12 and the vane contour in the base cross section 9.11 change in such a highly monotonous manner starting from the different vane inlet angles because of the different vane angle distribution over the meridional length so that the vane outlet angles at the radial inner vane outlet 14 are identical.

In addition to the above-described embodiment in which the inlet edge 13 of the return vanes 9 is parallel to the axis of rotation A, FIG. 1 shows in dashed lines a first construction which differs from the constructions shown in solid lines or dash-double-dotted lines and in which the inlet edge 13' is inclined by about 45° relative to the axis A. In this case, the outer diameter D can be defined, for example, as the minimum distance of the inlet edge 13' from the longitudinal axis A. FIG. 1 shows a second construction in dash-dot lines which differs from the construction shown in solid lines or dash-double-dotted lines and in which the inlet edge 13" is parallel to the axis of rotation A but, in contrast to the construction described above, projects radially into the deflecting channel 7.

The invention is not limited by the embodiments described above which are presented as examples only but can be modified in various ways within the scope of protection defined by the appended patent claims.

We claim:

1. A multistage radial compressor (1) with at least two compressor stages for compressing a fluid, comprising a compressor housing (16); a flow channel (2) formed within said housing for compressing the fluid; a deflecting channel having a radius of curvature and a length; an impeller (4) having a plurality of impeller vanes (5) arranged in said flow channel (2) and rotatable with said impeller (4) around a driveshaft (A); a 3D return blading (8) having a plurality of return vanes (9; 9') each comprising a vane base and a vane head axially downstream thereof, said return vanes being fixed with respect to rotation relative to said compressor housing (16); said flow channel (2) having a curved deflecting channel (7; 7') arranged in front of said return vanes (9; 9') in the direction of flow; wherein at least one of said vane base (11) and said vane head (12) of said return vanes (9) of said 3D return blading (8) has a curvature; and wherein at least one of said radius of curvature (R(ρ)) of said deflecting channel (7') varies over said length of said deflecting channel and said return vanes (9; 9') of said 3D return blading (8) have a first vane angle distribution (17) at said vane base (11) and a second relatively different vane angle distribution (18) at said vane head (12), wherein at least one of an axial height (H) of said vane base (11) and an axial height (h) of said vane head (12) varies over said length of said return vanes (9), said vane base (11) being curved so that its axial height (H) initially increases over the length of said return vanes (9), starting from a minimum at a vane inlet (13) until a maximum approximately in the center of said return vanes and then decreases again to another minimum.

2. The radial compressor according to claim 1, wherein one of the curve of the axial height (H) of said vane base (11) and of said axial height (h) of said vane head (12) has at least one of a local extremum and an inflection point over said length of said return vanes (9).

3. The radial compressor according to claim 1, wherein said radius of curvature (R(p)) of said deflecting channel (7') over said length of said return vanes (9) has at least one of a local extremum and an inflection point.

4. The radial compressor according to claim 1, wherein a first vane outlet angle at said vane head (12) is substantially identical to a second vane outlet angle at said vane base (11) at said exit from said return blading (8).

5. The radial compressor according to claim 4, wherein one of said first and second vane outlet angles is in the range between 80° and 100° .

6. The radial compressor according to claim 4, wherein one of said first and second vane outlet angles is in the range between 85° and 95° .

7. The radial compressor according to claim 4, wherein one of said first and second vane outlet angles is substantially 90° .

8. The radial compressor according to claim 1, additionally comprising an inlet into said return blading and an outlet out of said return blading and wherein one of a first vane angle at said vane base (11) and a second vane angle at said vane head (12) increases or decreases monotonously between said inlet into said return blading (8) and said outlet out of said return blading (8).

9. The radial compressor according to claim 1, wherein said return vanes (9) comprise an outer diameter (D) and an inner diameter (d), and wherein said ratio between said outer diameter and said inner diameter (D/d) is less than or equal to 1.6.

10. The radial compressor according to claim 1, wherein said return vanes (9) comprise an upstream inlet edge (13; 13'; 13") facing said deflecting channel (7); said upstream inlet edge being one of substantially parallel to a longitudinal axis of said compressor, enclosing an angle with said longitudinal axis and projecting into said deflecting channel (7).

11. The radial compressor according to claim 10, wherein said upstream inlet edge encloses an angle with the longitudinal axis of between 5° and 65° .

12. A compressor housing for a radial compressor according to claim 1, comprising a flow channel (2) formed in said compressor housing (16) for a fluid to be compressed; a 3D return blading (8) with a plurality of return vanes (9) which are fixed with respect to rotation relative to said compressor housing (16); wherein at least one of said vane bases (11) and vane heads (12) of said return vanes (9) of said 3D return blading (8) has a curvature and said return vanes (9) have a first vane angle distribution (17) at said vane base (11) and a second relatively different vane angle distribution (18) at said vane head (12).

13. Return vanes (9) for a 3D return blading (8) of the radial compressor according to claim 1, wherein at least one of said vane base (11) and vane head (12) of said return vanes (9) of said 3D return blading (8) has a curvature and said return vanes (9) have a first vane angle distribution (17) at said vane base (11) and a second relatively different vane angle distribution (18) at said vane head (12).

14. The radial compressor according to claim 1, wherein said return vanes (9) comprise an outer diameter (D) and an inner diameter (d), and wherein said ratio between said outer diameter and said inner diameter (D/d) is less than or equal to 1.55.

15. A multistage radial compressor (1) with at least two compressor stages for compressing a fluid, comprising a compressor housing (16); a flow channel (2) formed within said housing for compressing the fluid;

a deflecting channel having a radius of curvature and a length; an impeller (4) having a plurality of impeller vanes (5) arranged in said flow channel (2) and rotatable with said impeller (4) around a driveshaft (A); a 3D return blading (8) having a plurality of return vanes (9; 9') each comprising a vane base and a vane head axially downstream thereof, said return vanes being fixed with respect to rotation relative to said compressor housing (16); said flow channel (2) having a curved deflecting channel (7; 7') arranged in front of said return vanes (9; 9') in the direction of flow; wherein at least one of said vane base (11) and said vane head (12) of said return vanes (9) of said 3D return blading (8) has a curvature; and wherein at least one of said radius of curvature (R(ρ)) of said deflecting channel (7') varies over said length of said deflecting channel and said return vanes (9; 9') of said 3D return blading (8) have a first vane angle distribution (17) at said vane base (11; 11') and a second relatively different vane angle distribution (18) at said vane head (12; 12'), wherein said return blading comprises an inlet and said vane base has a first vane inlet angle ($\beta_{1,\ hub}$) and said vane head has a second vane inlet angle ($\beta_{1,\ shroud}$); and wherein at said inlet into said return blading (8) said first vane inlet angle ($\beta_{1,\ hub}$) at said vane base (11) is greater than or less than said second vane inlet angle ($\beta_{i,\ shroud}$) at said vane head (12).

16. The radial compressor according to claim 15, wherein said one of said first and second vane inlet angles ($\beta_{1,\ hub}$) is at least 1.1-times greater than said other of said first and second vane inlet angles ($\beta_{1,\ shroud}$).

17. The radial compressor according to claim 15, wherein one of said first and second vane inlet angles ($\beta_{1,\ hub}$) is greater or less than said other of said first and second vane inlet angles ($\beta_{1,\ shroud}$) by at least 5° .

18. The radial compressor according to claim 15, wherein said one of said first and second vane inlet angles ($\beta_{1,\ hub}$) is at least 1.2-times greater than said other of said first and second vane inlet angles ($\beta_{1,\ shroud}$).

19. The radial compressor according to claim 15, wherein said one of said first and second vane inlet angles ($\beta_{1,\ hub}$) is at least 1.3-times greater than said other of said first and second vane inlet angles ($\beta_{1,\ shroud}$).

20. The radial compressor according to claim 15, wherein one of said first and second vane inlet angles ($\beta_{1,\ hub}$) is greater or less than said other of said first and second vane inlet angles ($\beta_{1,\ shroud}$) by at least 10° .

21. A multistage radial compressor (1) with at least two compressor stages for compressing a fluid, comprising a compressor housing (16); a flow channel (2) formed within said housing for compressing the fluid;

a deflecting channel having a radius of curvature and a length; an impeller (4) having a plurality of impeller vanes (5) arranged in said flow channel (2) and rotatable with said impeller (4) around a driveshaft (A); a 3D return blading (8) having aplurality of return vanes (9; 9) each comprising a vane base and a vane head axially downstream thereof, said return vanes being fixed with respect to rotation relative to said compressor housing (16); said flow channel (2) having a curved deflecting channel (7; 7') arranged in front of said return vanes (9; 9') in the direction of flow; wherein at least one of said vane base (11) and said vane head (12) of said return vanes (9) of said 3D return blading (8) has a curvature; and wherein at least one of said radius of curvature (R(ρ)) of said deflecting channel (7') varies over said length of said deflecting channel and said return vanes (9; 9') of said 3D return blading (8) have a first vane angle distribution (17) at said vane base (11; 11') and a second relatively different vane angle distribution (18) at said vane head (12; 12'), wherein said return vanes comprise a vane inlet (13) and a vane outlet (14); and wherein a second vane angle change ($\Delta\beta_{shroud}$) from said vane inlet (13) to said vane outlet (14) at one of said vane head (12) and said vane base is at least 1.1-times a first vane angle change ($\Delta\beta_{hd\ hub}$) from said vane inlet (13) to said vane outlet (14) at said other one of said vane head (12) and said vane base (11).

22. A multistage radial compressor (1) with at least two compressor stages for compressing a fluid, comprising a compressor housing (16); a flow channel (2) formed within said housing for compressing the fluid;

a deflecting channel having a radius of curvature and a length; an impeller (4) having a plurality of impeller vanes (5) arranged in said flow channel (2) and rotatable with said impeller (4) around a driveshaft (A); a 3D return blading (8) having a plurality of return vanes (9; 9') each comprising a vane base and a vane head axially downstream thereof, said return vanes being fixed with respect to rotation relative to said compressor housing (16); said flow channel (2) having a curved deflecting channel (7; 7') arranged in front of said return vanes (9; 9') in the direction of flow; wherein at least one of said vane base (11) and said vane head (12) of said return vanes (9) of said 3D return blading (8) has a curvature; and wherein at least one of said radius of curvature (R(ρ)) of said deflecting channel (7') varies over said length of said deflecting channel and said return vanes (9; 9') of said 3D return blading (8) have a first vane angle distribution (17) at said vane base (11; 11') and a second relatively different vane angle distribution (18) at said vane head (12; 12'), wherein said return vanes (9) have vane surfaces; said vane surfaces of said return vanes (9) being represented by rulings.

23. A multistage radial compressor (1) with at least two compressor stages for compressing a fluid, comprising a compressor housing (16); a flow channel (2) formed within said housing for compressing the fluid;

a deflecting channel having a radius of curvature and a length; an impeller (4) having a plurality of impeller vanes (5) arranged in said flow channel (2) and rotatable with said impeller (4) around a driveshaft (A); a 3D return blading (8) having a plurality of return vanes (9; 9') each comprising a vane base and a vane head axially downstream thereof, said return vanes being fixed with respect to rotation relative to said compressor housing (16); said flow channel (2) having a curved deflecting channel (7; 7') arranged in front of said return vanes (9; 9') in the direction of flow; wherein at least one of said vane base (11) and said vane head (12) of said return vanes (9) of said 3D return blading (8) has a curvature; and wherein at least one of said radius of curvature (R(ρ)) of said deflecting channel (7') varies over said length of said deflecting channel and said return vanes (9; 9') of said 3D return blading (8) have a first vane angle distribution (17) at said vane base (11; 11') and a second relatively different vane angle distribution (18) at said vane head (12; 12'), wherein said return vanes comprise a vane inlet (13) and a vane outlet (14); and wherein a second vane angle change ($\Delta\beta_{shroud}$) from said vane inlet (13) to said vane outlet (14) at one of said vane head (12) and said vane base is at least 1.14-times a first vane angle change ($\Delta\beta_{hub}$) from said vane inlet (13) to said vane outlet (14) at said other one of said vane head (12) and said vane base (11).

* * * * *